US008062481B2

(12) United States Patent
Gustavsson

(10) Patent No.: US 8,062,481 B2
(45) **Date of Patent: *Nov. 22, 2011**

(54) SUPPORT BODY FOR AN APPARATUS HAVING AN EXTENDED NIP FOR THE TREATMENT OF A FIBRE WEB

(75) Inventor: Tord Gustav Gustavsson, Forshaga (SE)

(73) Assignee: Metso Paper Karlstad AB (SE)

( * ) Notice: Subject to any disclaimer, the term of this patent is extended or adjusted under 35 U.S.C. 154(b) by 441 days.

This patent is subject to a terminal disclaimer.

(21) Appl. No.: 12/297,785

(22) PCT Filed: Apr. 16, 2007

(86) PCT No.: PCT/SE2007/000352

§ 371 (c)(1),
(2), (4) Date: Oct. 20, 2008

(87) PCT Pub. No.: WO2007/123457

PCT Pub. Date: Nov. 1, 2007

(65) Prior Publication Data

US 2009/0173465 A1 Jul. 9, 2009

(51) Int. Cl.
*D21F 3/06* (2006.01)
*B30B 5/02* (2006.01)

(52) U.S. Cl. ..... 162/358.3; 162/205; 100/156

(58) Field of Classification Search ..... 162/204–207, 162/358.1, 358.3, 358.5, 220, 405; 100/37, 100/38, 153, 156, 160, 170; 492/20
See application file for complete search history.

(56) References Cited

U.S. PATENT DOCUMENTS

| | | | |
|---|---|---|---|
| 3,293,121 | A | 12/1966 | Martin |
| 3,839,147 | A | 10/1974 | Daane |
| 4,468,287 | A | 8/1984 | Dahl |
| 4,576,682 | A | 3/1986 | Laapotti |
| 4,851,119 | A | 7/1989 | Bergloff et al. |
| 5,614,064 | A | 3/1997 | Nykopp |
| 5,951,824 | A | 9/1999 | Deshpande |
| 5,980,693 | A | 11/1999 | Liang et al. |
| 6,334,933 | B1 | 1/2002 | Koski |
| 6,387,216 | B1 | 5/2002 | Koski |
| 6,835,283 | B2 | 12/2004 | Weigant et al. |
| 7,527,708 | B2 * | 5/2009 | Gustavsson ..... 162/358.3 |

FOREIGN PATENT DOCUMENTS

| | | | |
|---|---|---|---|
| DE | 3030233 | A1 | 2/1982 |
| DE | 4405587 | A1 | 9/1994 |
| EP | 0575353 | B1 | 12/1993 |
| EP | 1319744 | A2 | 6/2003 |
| WO | 0244467 | A1 | 6/2002 |
| WO | 2005038129 | A1 | 4/2005 |

* cited by examiner

*Primary Examiner* — Eric Hug
(74) *Attorney, Agent, or Firm* — Brooks Kushman P.C.

(57) ABSTRACT

A support body for an apparatus having an extended nip formed between the support body and a counter-pressure member, having a working surface, being elastically deformable, and comprising a plurality of pressure chambers pressurized for controlled expanding in the direction of the working surface in order to load the nip. According to the invention the support body comprises a plurality of reinforcing profiles disposed in at least one chamber of the pressure chambers, the interiors of the profiles being in fluid communication with one another via holes, a wall of the profile facing said working surface including holes for communicating fluid between the interior of the profile and the chamber in which said profile is located, said profiles providing an inner support to walls defining said at least one chamber.

21 Claims, 5 Drawing Sheets

SUPPORT BODY FOR AN APPARATUS HAVING AN EXTENDED NIP FOR THE TREATMENT OF A FIBRE WEB

CROSS-REFERENCE TO RELATED APPLICATION

This application claims priority to U.S. application Ser. No. 11/408,340, now U.S. Pat. No. 7,527,708, filed Apr. 21 2006.

BACKGROUND OF THE INVENTION

The present invention relates to a support body for an apparatus having an extended nip formed between the support body and a counter-pressure member, said support body having a working surface, and being elastically deformable, and comprising a plurality of pressure chambers that are arranged to be pressurized for controlled expanding in the direction of the working surface in order to load the nip via said working surface.

The invention also relates to a support body assembly for an apparatus having an extended nip N, comprising:

- a support body having a working surface, and being elastically deformable, and comprising a plurality of pressure chambers said nip (N) being formed between the support body and a counter-pressure member, said chambers being arranged to be pressurized in order to load the nip (N) via said working surface; and
- a holding device for the support body, the holding device providing an outer support to all sides of the support body having said pressure chambers except the side of the working surface so that a pressurization of the pressure chambers cause the pressure chambers to expand in a controlled manner in the direction of said working surface.

The invention also relates to an apparatus for the treatment of a fibre web being manufactured in a paper or board machine, comprising:

- a first structural element, and a second structural element movably arranged with respect to the first structural element and having a counter-pressure surface for interaction with the first structural element to form an extended nip, said first structural element including:
  - a movable clothing;
  - a support body assembly, including
    - a support body having a working surface that together with the counter-pressure surface defines said nip, said support body being elastically deformable and comprising a plurality of pressure chambers arranged to be pressurized in order to load the nip via said contact surface; and
    - a holding device for the support body, the holding device providing an outer support to sides of the pressure chambers except at a side of the pressure chambers facing said working surface so that a pressurization of the pressure chambers cause the pressure chambers to expand in the direction of said working surface.

The previously known presses with an extended press nip have a so-called press shoe, which consists of a metallic material, such as aluminium or steel, and are designed with a press surface, usually a concave press surface, whose profile is very accurately adapted to the opposed counter-pressure surface. Such a press shoe is very complicated to manufacture and therefore involves a very high cost. Due to the fact that it consists of metal, it is relatively rigid and inflexible. The press roll acting as a counter roll such a shoe press can have a relatively thick cylinder wall which withstands the forces from the press shoe. In accordance with another embodiment of the counter roll, it has a relatively thin cylinder wall and is provided internally with a counter-pressure system for adjustable crowning of the thin and, thus, deformable cylinder wall or shell in dependence of the forces the press shoe has to apply on the counter roll in order to obtain the desired load. Also the press shoe can be crowned in accordance with the crowning of the counter roll, and it will then be usable only in combination with this counter roll. Alternatively, the metallic press shoe can be tilted by means of hydraulic cylinders.

A Yankee cylinder has a cylinder wall or shell which is relatively thin, and which easily is deformed by impression of the press shoe when the Yankee cylinder is used as a counter roll. The deformation of the shell varies in an axial direction from the central region in a direction towards the end walls, where the impression is substantially smaller than within the central region. Therefore, the press shoe will act with a higher pressure at and in the vicinity of the end walls, resulting in an increased wear at the edges of the press felt and an irregular load profile along the press shoe, something which in its turn results in variable paper properties crosswise to the machine direction. It has been proposed to crown the shell of the Yankee cylinder by means of an internal counter-pressure system, or to arrange two or more rows of hydraulic cylinders on the underside of the press shoe for influencing the press shoe to conform to the deformed surface, in both cases in order to achieve a more uniform load profile. Both proposals, however, are complicated and expensive to carry out.

The following documents are examples of presses having extended press nips.

DE 44 05 587 and WO 02/44467 describe a press having a hydrostatic bearing, including a press shoe 3 or double press shoes 3*a*, 3*b* of the same design. A press belt 6 rotates on top of a lubricating fluid bed of the press shoe 3 with a very small friction. The press shoe, which is made of metal, has a pressure chamber 10 containing a hydraulic fluid, preferably water. A rectangular pressure-equalizing membrane 20, consisting of a suitable solid material, preferably stainless steel, is fixed on the press nip side of the press shoe. The pressure-equalizing membrane 20 has an outer edge 26, an inner edge 22, and an opening 27 that is defined by the inner edge 22. The pressure-equalizing membrane 20, thus looking like a frame, is flexible so that an edge zone 21, standing in direct contact with the hydraulic fluid, can deflect when pressure differences occur between its two sides. These pressure differences arise when hydraulic fluid happens to leak out through the press nip as a result of irregularities in the paper web and/or in the envelope surface of the counter roll. Thus, the flexible pressure-equalizing membrane 20 creates a self-adjusting nip 2, having no or only a minimum of fluid leakage. Thus, through the opening 27 in the pressure-equalizing membrane 20, the pressure fluid in the pressure chamber 10 stands in direct contact with the movable belt. The complementary addition which has been done in said WO-publication in comparison to said DE-publication is that the flexible membrane has been provided with "pinholes 255" within its free edge zone 21 in order to conduct hydraulic fluid from the pressure chamber 10 to the belt 6 for the purpose of lubricating the belt.

U.S. Pat. No. 5,980,693 describes presses having a tube-shaped or inflatable loading element, but with a metal shoe between the loading element and the inside of the belt. Furthermore, this part of the shoe is constructed in order to provide a slow reduction of the pressure in nip outlet. Normally, an abrupt pressure drop is desired.

U.S. Pat. No. 3,839,147 describes a shoe press having two opposed shoes. Each shoe has a metal bottom and sills, sealing against the inside of the belt. The side of the shoe facing the belt is a perforated diaphragm, which causes the pressure of the hydraulic fluid in a pressure chamber to load the inside of the belt directly. The shoe is of a rather complicated construction with various apertures and reinforcements.

U.S. Pat. No. 5,951,824 describes an ordinary shoe having ordinary hydraulic loading elements. The shoe is coated with a soft and durable layer of polymer or rubber in order to reduce the risk of damages to the belt and shoe from paper wads passing through the press nip.

EP 0 575 353 describes a press having a shoe, which is loaded with bellows being arranged inside a metal cover of the shoe, wherein a belt slides around said metal cover.

U.S. Pat. No. 6,334,933 describes a press having a counterpart of metal, which is provided with a plurality of pressure pockets being sealed by a metal plate and hoses, which also can contribute to loading the opposite portions of the press nip.

U.S. Pat. No. 6,387,216 describes a press having an open fluid chamber, over which a belt is running and which is loading the press nip. The chamber is sealed by means of setting the belt under pressure, so that it is tightened over the edges of the chamber.

EP 1 319 744 describes a method for measuring and regulating the nip pressure in a shoe press, crosswise to and along the web, by means of measuring and continuously adapting the hydraulic static pressure in reference points above measurement holes in the press nip.

DE 30 30 233 describes an elastic slide shoe which is attached to a stand of metal. The slide shoe includes a solid body or a hollow body in the form of a hose which can be filled with a pressure medium. The hose is surrounded by an elastic belt which is attached to the metal stand. The hollow body may be divided into chambers which can be pressurized to different pressures. However, a change of pressure in the chamber or chambers does not result in a change of the loading in the nip because of the fact that the hollow body is permitted to expand laterally during every such increase of pressure.

Wo 2005/038129 A1 describes an elastic support body which, in relation to known support bodies, can be manufactured in a more simple way, without any special machining and without any major consideration to the shape of the opposed surface which it is to work against, and which can provide a loading profile in dependence of the pressure in the pressure chamber or pressure chambers in the same way or even in a better way than what is possible with a conventional support body of metal with one or more rows of pressure pockets which are closed by running belt.

It is an object of the present invention to provide an improved elastic support body having inner support arrangement embedded therein which withstands the differential pressure between adjacent pressure chambers, especially at higher differential pressures, in a desired way.

The support body according to the invention is characterized in that the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

The support body assembly according to the invention is characterized in that the support body is designed in accordance with any one of claims 1-12.

The apparatus according to the invention is characterized in that the support body assembly is designed in accordance with claim 13 or claim 14.

The expression "nip" is to be interpreted in its broadest meaning in order to encompass such a nip that is defined by a wire and support body.

BRIEF DESCRIPTION OF DRAWINGS

Figure 1:
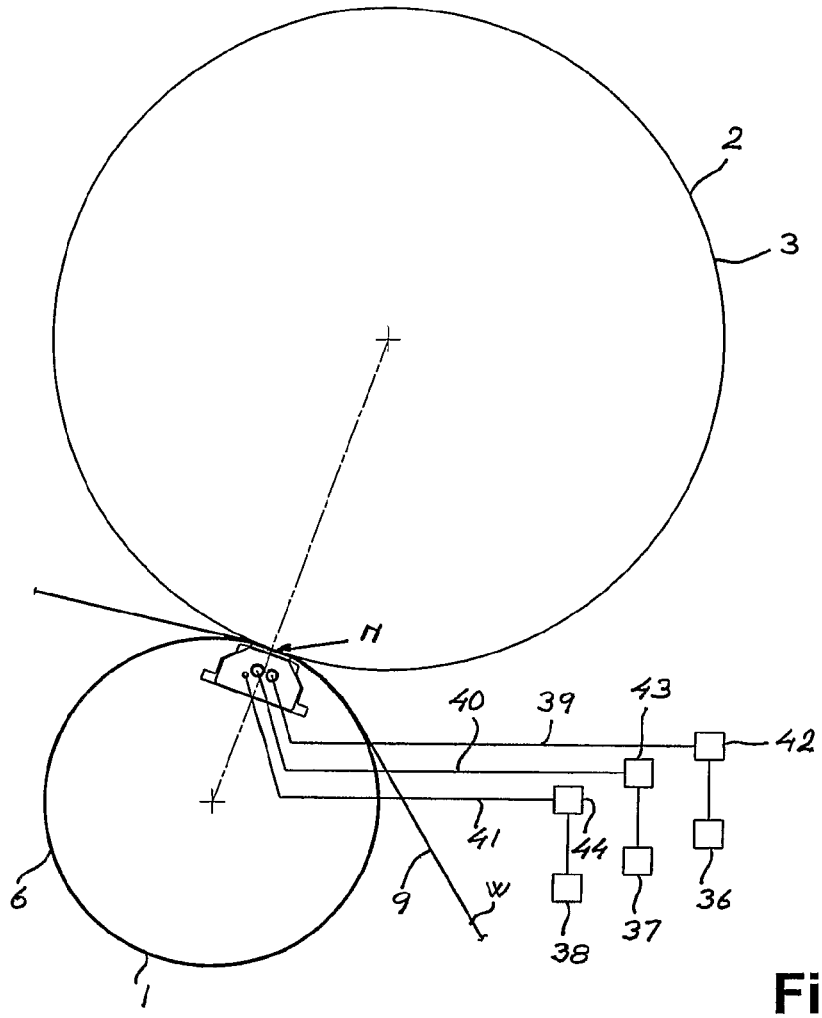

Having thus described the invention in general terms, reference will now be made to the accompanying drawings, which are not necessarily drawn to scale, and wherein:

FIG. 1 shows a press with a press body and its holding device according to the invention.

Figure 2:
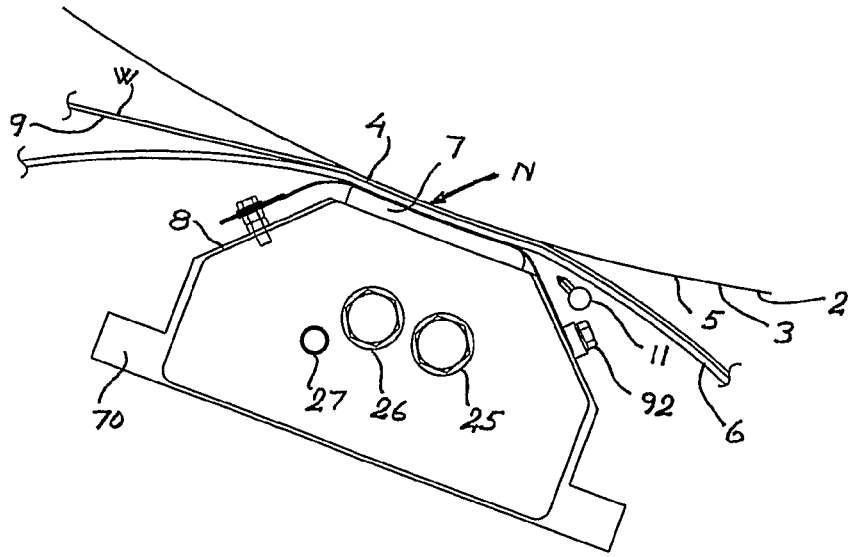

FIG. 2 shows the nip region of the press according to FIG. 1 including the press body and holding device.

Figure 3:
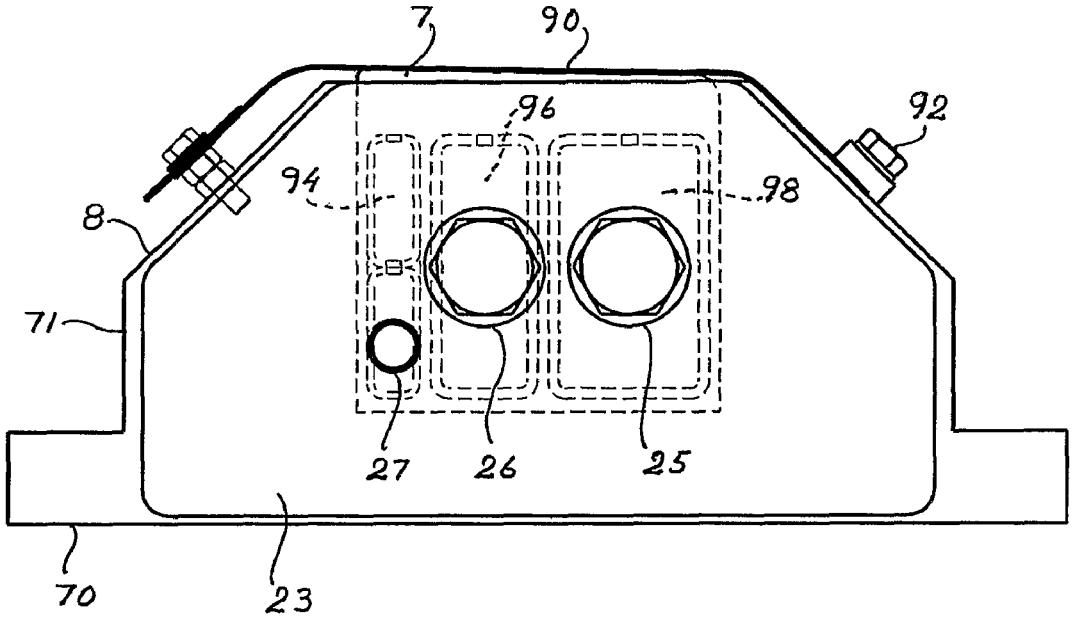

FIG. 3 is an end view of the holding device and press body according to FIGS. 1 and 2.

Figure 4:
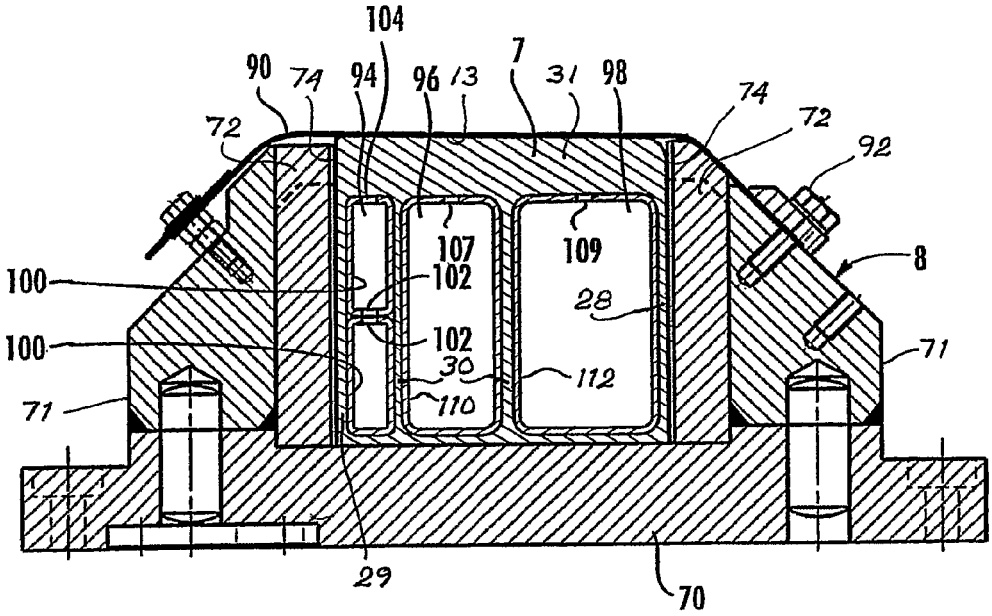

FIG. 4 is a cross-sectional view through the holding device and press body with press chambers and reinforcing profiles according to a first embodiment of the invention, in a non-pressurized condition.

Figure 5:
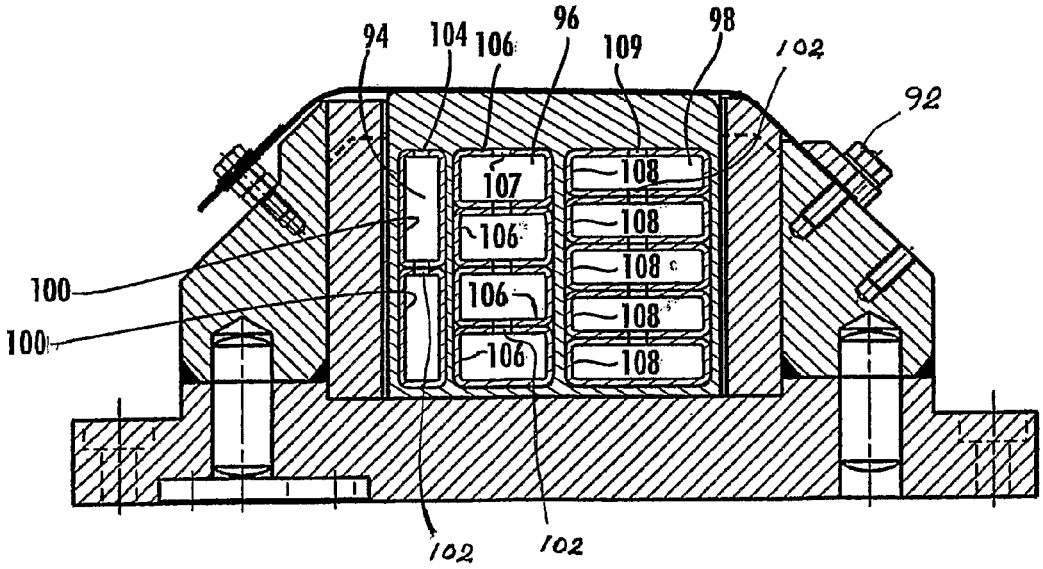

FIG. 5 is a cross-sectional view through the holding device and press body with press chambers and reinforcing profiles according to a second embodiment of the invention, in a non-pressurized condition.

Figure 6:
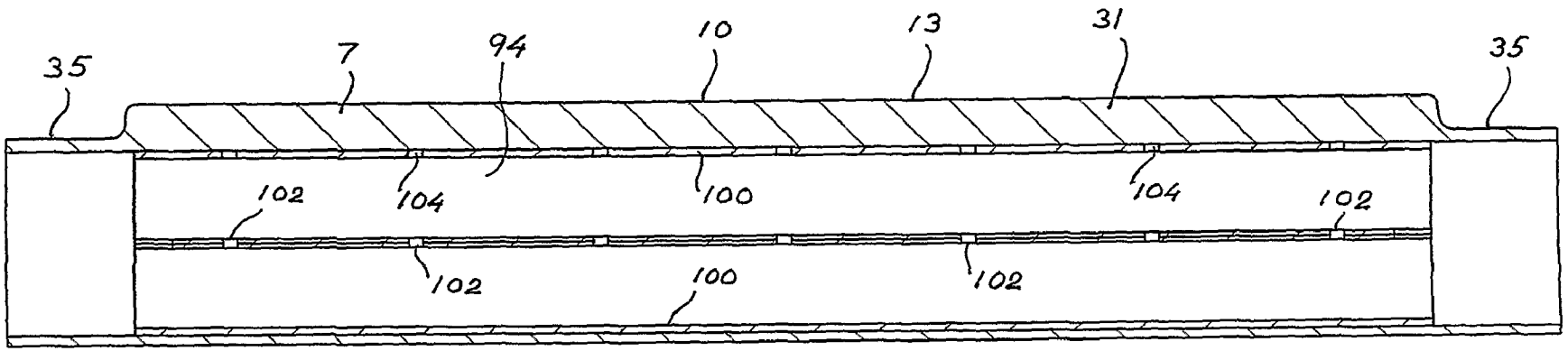

FIG. 6 is a longitudinal section of the press body along the downstream chamber with two profiles according to FIG. 4.

Figure 7:
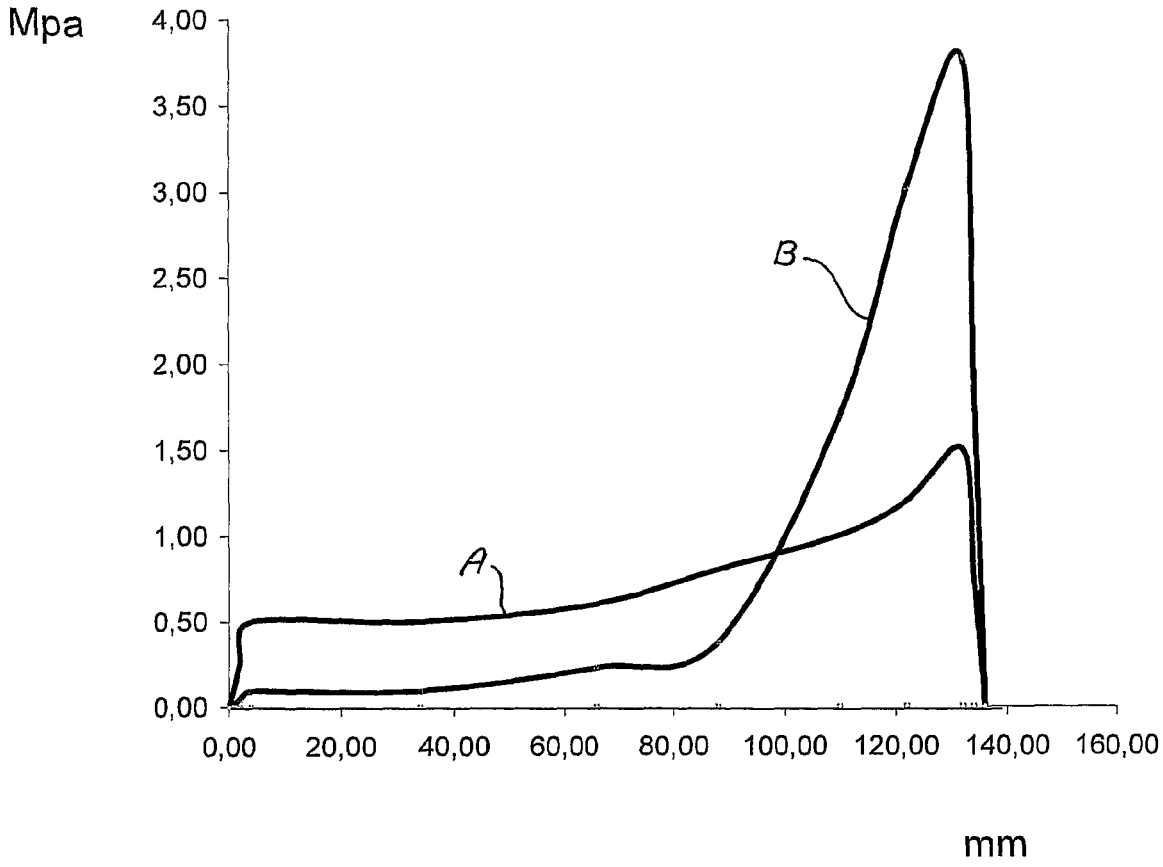

FIG. 7 is a graph depicting two pressure curves obtained with the press body according to FIG. 5.

DETAILED DESCRIPTION OF THE INVENTION

The invention is an improvement of the support body assembly described and shown in WO 2005/038129 A1 that is incorporated herein by reference, in particular the embodiments of the support body having a plurality of pressure chambers.

The invention will be described in connection with a press for dewatering a fibre web. Naturally, in addition to the press section, the invention can be applied to any suitable apparatus for the treatment of a fibre web, e.g. an apparatus in a drying or forming section of a paper or board machine, and in a calendar for surface treatment of the fibre web. FIGS. 1 and 2 show schematically portions of a press which is arranged in the press section of a paper or board machine in order to press water out of a formed, wet fibre web. Advantageously, the invention can be used in a paper machine of the tissue machine type. The press includes a first press element 1 and a second press element 2. The press elements 1, 2 are interacting with each other in order to form an extended press nip N. The second press element 2 includes a counter-pressure member being active in the press nip N and having a movable, endless surface 3, which forms an opposed surface or counter-pressure surface 4, which can be curved or linear, within the press nip N. In the shown embodiment of the press, the second press element 2 consists of a counter roll in the form of a press roll. The counter roll also can be a drying cylinder in a conventional drying section, or a drying cylinder in a tissue machine designated Yankee cylinder. In this case, the counter-pressure member includes the cylindrical wall 5 of the counter roll 2 the envelope surface of which forms said movable, endless surface 3, which within the extended press nip N forms said counter-pressure surface 4, which can be at room temperature or a temperature raised by means of heating. Provided that the cylinder wall 5 is thick and stable enough, it constitutes the counter-pressure member as such. In the case when the cylinder wall 5 is thin and deformable, the counter-pressure member further includes an internal supporting system (not shown), which provides the necessary counter-force.

The first press element 1 includes a movable, endless belt 6 of a flexible material, and a support body assembly that includes a support body 7 in the form of a press body, a holding device 8 for mounting and supporting the press body 7, a mounting device for mounting the holding device 8, and a loading device for activating the press body 7. The holding device 8 functions as an outer counter support. The movable belt 6 describes a closed loop inside of which the press body 7 and the mounting device are located. Before the press nip N, the movable belt 6 is arranged for meeting a press felt 9 carrying a wet fibre web W which is to be dewatered when it passes through the extended press nip. The loading device is arranged for being activated in order to influence the press body 7 during the operation of the press for obtaining pressure forces which the press body 7 exerts against the counter roll 2 via the belt 6, the press felt 9 and the web W. The press body 7 is arranged for deciding the length of the extended press nip N, as seen in the machine direction. The press body 7 has a free surface 10 that entirely or partially forms a working surface or press surface 13, which together with said counter-pressure surface 4 defines the press nip N. A spraying device 11 is mounted upstream the press body 7 for supplying lubricant on the inside of the belt 6 in order to form a film which reduces the friction between the rotating belt 6 and the press body 7.

In the shown embodiment of the press, the first press element 1 consists of a press roll the shell of which forms the movable belt 6 which thus describes a substantially circular loop. In an alternative embodiment of the press (not shown), the flexible, movable belt is arranged for running in a non-circular loop, e.g. in a substantially oval loop or in a substantially triangular loop, around the press body and one or several guide rolls. The press roll 1 has two circular, rotatably mounted end walls, whereby the shell 6 is rigidly mounted to the peripheries of the end walls in order to rotate together with them. The shell 6 and the end walls define a closed space in which the above-mentioned mounting device is located, said mounting device including a stationary supporting beam extending axially between the end walls without touching them. Also the press body 7 and its holding device 8 are extending axially between said end walls without touching them. Alternatively, the second press element 2 can be of the same or substantially the same design as the above-described first press element 1, whereby the press nip N thus is formed by two press bodies according to the invention.

The elastically deformable support body 7 is supported by the counter support or holding device 8. The holding device 8 includes a base plate 70 and parallel, spaced side plates 71 which are welded to the base plate 70 forming therebetween a space for receiving the press body 7 and opposite spacers 72 and shims 74 (FIG. 4) as necessary to fill said space such that the press body 7 is securely held by the holding device 8 substantially without any "play". The opposite ends 35 of the press body 7 (see FIG. 6) have reduced height and extend beneath clamping plates (not shown) affixed to the holding device 8 for fixing the press body 7 in the holding device 8.

The press body 7 is elastically deformable and has its press or working surface 13 adaptable to said counter-pressure surface 4 in interaction with this. This adaptation takes place under the influence of a load being created by said loading device, on the press body 7 in a direction towards the counter-pressure surface 4 in order to load the entire press nip N correspondingly. The definition that the press body 7 is elastically deformable does not necessarily imply that the entire press body 7 consists of an elastic material, but should in the context of the invention be seen in a broader sense, namely that the press body 7 has at least one functional portion consisting of an elastic material and fulfilling said definition. For practical and production-engineering reasons, and according to the most preferred embodiments the press body 7 is in its entirety made of an elastic material (or several).

In the embodiments shown, the support body 7 includes three pressure chambers 94, 96, 98 of different sizes. More particularly, the downstream chamber 94 has the smallest machine-direction dimension of the three chambers. The middle chamber 96 has a larger machine-direction dimension than the downstream chamber 94, and the upstream chamber 98 has the largest machine-direction.

The holding device 8 includes two end plates 23 (see FIG. 3). One of the end plates 23 is provided with connecting members 25, 26, 27 forming inlets for a pressure medium in gas or liquid form, preferably hydraulic oil. The other end plate (not shown) is provided with similar connecting members, forming outlets for deaeration of pressure chambers 98, 96, 94 when hydraulic oil is used. Said loading device includes the pressure chambers 98, 96, 94 and pressure medium sources 36, 37, 38 that are connected to the pressure chambers 98, 96, 94 via pipes 39, 40, 41 and said connecting members 25, 26, 27. The pressure in the pressure chambers 98, 96, 94 is regulated by means of suitable control devices 42, 43, 44.

As mentioned in the foregoing, the press body 7 is elastically deformable in order to expand, under the influence of an increased pressure in the pressure chambers 98, 96, 94, and bring the top wall 31 (FIG. 6) of the press body 7 with its press surface 13 in a direction towards the counter-pressure surface 4 of the counter roll 2 as is described and shown in WO 2005/038129 A1. The press body 7 is hollow and made in one piece of an elastic material. The press body 7 is mounted in a starting position with its press surface 13 situated at a predetermined distance from the opposite counter-pressure surface 4. When the press is put into operation, the pressure in the pressure chambers 98, 96, 94 is increased in order to obtain a nip-forming operation position. The increase of pressure causes the press body 7 to expand elastically in relation to the holding device 8 in a direction towards the counter-pressure surface 4 of the counter roll 2, since the upstream and downstream side walls 28, 29 and the partition wall 30 have the freedom to stretch or expand elastically until counter-forces arise from the counter-pressure surface 4 of the counter roll 2. These counter-forces first appear at the outlet of the press nip, i.e. just opposite the downstream side wall 29, and then propagates successively in a direction towards the inlet of the press nip the position of which is determined by the maximum pressure value which is pre-set for a desired load. Accordingly, during said elastic expansion of the press body 7, the top wall 31, and the rotating belt 6 facing the top wall 31, will be pressed in a direction towards the counter roll 2, wherein the top wall 31 is elastically deformed both in the machine direction MD and crosswise to the machine direction CD in dependence of the shape of the counter-pressure surface, i.e. the press surface 13 conforms to and adopts the outline of the counter-pressure surface, and the portion of the surface 10 defining the press nip, i.e. the press surface 13, which in this case forms a press zone, changes its form in accordance with the opposed counter-pressure surface of the counter roll. Alternatively, the press body 7 is mounted in a first starting position with its press surface 13 situated spaced from the corresponding counter-pressure surface. The press body 7 and the holding device 8 are together moved from the first starting position by means of a suitable movement transmitting device to a second starting position with the press surface 13 of the press body 7 close to or nearly close to the opposite counter-pressure surface. The pressure is then increased in the pressure chambers for attaining a nip-forming operation position and the desired pressure curve.

The press body 7 can further include an exchangeable wear protection layer 90 that covers the working surface 13 of the press body 7. The wear protection layer 90 comprises a flexible sheet of suitable material such as a polymer film. In this particular embodiment, thordon is used, however, other materials can be used having suitable ability of low friction and resistance to wear. The wear protection layer can be removed and replaced with a new layer when it becomes worn. In this manner, wear of the press body 7 is substantially prevented and the press body can be easily and inexpensively restored to a like-new condition. The upstream edge of the wear protection layer 90 is rigidly affixed to an upstream side of the holding device 8, such as by fasteners 92 or the like. The downstream edge of the wear protection layer 90 can be left free to follow movement and deformation of the support body 7.

According to the present invention the support body 7 is provided with a plurality of continuous reinforcing elements or profiles disposed in one, some or all of the pressure chambers 94, 96, 98.

In the embodiment shown in FIG. 4 a pair of continuous reinforcing internal hollow profiles 100 is disposed in the downstream chamber 94. The profiles are in form of metal tubes of generally rectangular cross-sectional shape. The tubes 100 are stacked one atop the other and rigidly joined together, such as by welding or the like. Each tube 100 has a height that is substantially half the height of the chamber 94 in its non-pressurized condition. This arrangement provides increased bending stiffness relative to a single reinforcing tube of full height. Holes 102 are provided between the tubes 100 for communicating fluid between their interiors. The holes 102 are spaced apart in the cross-machine direction along the tubes 100. A series of holes 104 are formed in the top wall of the upper tube 100 for communicating fluid from the interiors of the tubes 100 to the interior of the chamber 94. The holes 104 are spaced apart in the cross-machine direction along the upper tube 100.

The middle chamber 96 includes a single internal reinforcing profile or tube 110 having holes 107 in its top wall, and the upstream chamber 98 includes a single internal reinforcing profile or tube 112 having holes 109 in its top wall. The interiors of each of the reinforcing tubes 100, 110, 112 can be supplied with separate fluid streams, which can have different pressures, for pressurizing the chambers 94, 96, 98 independently of one another for influencing the machine-direction profile of the working surface of the support body 7 in different ways for influencing the machine-direction pressure curve in the nip N in different ways.

The tubes are embedded in the press body 7 and function as an inner counter support or internal reinforcement, especially for the partition walls 30. The hollow profiles or tubes are used to increase the stiffness of the press body 7 for enabling the use of high differential pressure in two adjacent chambers.

In the embodiment shown in FIG. 5 the pressure chambers 94, 96, 98 are of the same sizes and shapes as in the prior embodiment, and the reinforcing tubes 100 for the downstream chamber 94 are the same, but the configurations of the reinforcing tubes for the middle and upstream chambers 96, 98 are different. In particular, the middle chamber 96 has a stack of four separate reinforcing profiles or tubes 106 stacked one atop another and rigidly joined together by welding or the like. There are holes 102 between the contiguous tubes 106 for communicating fluid between the respective interiors of the contiguous tubes. The top tube 106 has holes 107 as in the prior embodiment.

The upstream chamber 98 has a stack of five separate reinforcing profiles or tubes 108 stacked one atop another and rigidly joined together. There are holes 102 between the contiguous tubes 108 for communicating fluid between the respective interiors of the contiguous tubes. The top tube 108 has holes 109 as in the prior embodiment.

In the embodiments shown in FIGS. 4 and 5, the pressure in the chambers 98, 96, 94 normally is increasing in the machine direction, i.e. the pressure in the upstream chamber 98 is lower than in the middle chamber 96, and the pressure in the middle chamber 96 is lower than in the downstream chamber 94. The pressure ratio between the chambers 98, 96, 94 can vary from 1:2:3 to 1:5:40. The ratio 1:2:3 allows achieving a high bulk of the treated web, whereas the ratio 1:5:40 or higher allows achieving higher dryness of the web after the nip N. Different pressure ratio can be chosen depending on the grade of treated paper, and different products within the same paper grade, for instance, a paper towel web or toilet tissue web. The graph in FIG. 7 depicts a pressure curve A for said lower pressure ratio 1:2:3, and a pressure curve B for said higher pressure ratio 1:5:40. The linear load in the nip N was in both cases 100 kN/m.

In an alternative embodiment of FIG. 5 the profiles are omitted from the downstream chamber 94 (the smallest one). In an alternative embodiment of FIG. 4 the profiles are omitted from the downstream chamber 94 and instead profiles are disposed in the other chambers 96, 98 or at least in the middle one.

The press body 7 according to the invention has a number of essential advantages of which the following can be mentioned:

- It is self-conforming to the outline of the counter pressure surface.
- It conforms to and follows the deformation of the counter-pressure surface.
- It avoids abnormal wear of the edges of the press felt.
- It is forgiving to e.g. a paper wad passing through the press nip.
- It can be manufactured at a very low cost.
- It can be designed for controlling the load within the entire press nip, or within successive sections of the press nip and independently of each other.

The support bodies 7 which are described above and shown in the drawings have been designated press bodies, since they are used in a press apparatus. Naturally, the same embodiments of the press body can be used in other apparatus for the treatment of a fibre web in a paper or board machine, or in a calendar. When the invention is applied to e.g. a wire section, the belt of the first press element can be replaced with a clothing, such as e.g. a wire.

The linear load in the nip can vary from 0 to 1500 kN/m.

The support body may have a dimension in the machine direction (width) which typically is 50-500 mm.

The desirable elastic properties of the support body are achieved by means of an elastic material, having a coefficient of elasticity which is substantially lower than that of metal, such as steel and aluminium, so that the support body, depending on the construction of the support body, can be elastically expanded or elastically compressed. Typical hardness values of the elastic material is 50-95 Shore A. The elastic material should also give the support body a sufficient strength/hardness in order to withstand wear, but at the same time make the support body elastically deformable enough in order to obtain the desired function according to the invention. As elastic materials, plastic and rubber materials can be used, such as polymers, composite materials, which can be reinforced with e.g. glass fibres, carbon fibres or textile. At present, polyurethane is a preferred polymer.

The invention also refers to a method of forming an extended nip N in an apparatus for the treatment of a fibre web, said apparatus comprising a support body having a working surface, and being elastically deformable, and comprising a plurality of pressure chambers said nip N being formed between the support body and a counter-pressure member, said chambers being arranged to be pressurized in order to load the nip N via said working surface, wherein the method comprises the steps of:

mounting the support body in a holding device, the holding device providing an outer support to all sides of the support body having said pressure chambers except the side of the working surface, and pressurizing the pressure chambers to cause the pressure chambers to expand in a controlled manner in the direction of said working surface, wherein the support body being designed in accordance with any one of claims 1-12.

The invention also refers to a method of controlling the load in an extended nip N in an apparatus for the treatment of a fibre web, said apparatus comprising a support body having a working surface, and being elastically deformable, and comprising a plurality of pressure chambers said nip N being formed between the support body and a counter-pressure member, said chambers being arranged to be pressurized in order to load the nip N via said working surface, wherein the method comprises the steps of:

mounting the support body in a holding device, the holding device providing an outer support to all sides of the support body having said pressure chambers except the side of the working surface, pressurizing the pressure chambers to cause the pressure chambers to expand in a controlled manner in the direction of said working surface, and setting the pressures in the pressure chambers in accordance with a predetermined pattern to obtain a desired press curve, wherein the support body being designed in accordance with any one of claims 1-12.

According to a specific embodiment of this method the load in the press nip N may be controlled independently in the machine direction and/or crosswise to the machine direction.

The support body according to the invention can be used as a press body in a press apparatus in a paper or board machine, as a supporting foil for a carrying apparatus in a paper or board machine or as a reeling support in a reel-up of a paper or board machine.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A support body for an apparatus having an extended nip formed between the support body and a counter-pressure member, said support body having a working surface, and being elastically deformable, and comprising a plurality of pressure chambers that are arranged to be pressurized for controlled expanding in the direction of the working surface in order to load the nip via said working surface, wherein the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

2. The support body according to claim 1, wherein a plurality of reinforcing profiles are disposed also in at least one further chamber or that a plurality of reinforcing profiles are disposed in each of said plurality of chambers.

3. The support body according to claim 1, wherein a single reinforcing profile is disposed in the other chamber or chambers in which said plurality of profiles is not disposed, a wall of the single profile facing said working surface including holes for communicating fluid between the interior of the profile and the chamber in which the single profile is located, said single profile providing an inner support to walls defining said other chamber.

4. The support body according to claim 1, wherein said working surface of the support body is adaptable to a counter-pressure surface of said counter-pressure member when interacting with the counter-pressure surface.

5. The support body according to claim 1, wherein the support body is arranged such that a change of the pressure in said pressure chambers produces a corresponding change of pressure in the nip.

6. The support body according to claim 1, wherein the pressure chambers are axially through-going and are separated by partition walls.

7. The support body according to claim 1, wherein the support body is made of a polymer comprising plastic material or rubber material and a polymer based composite material with or without reinforcing fibre or textile material.

8. The support body according to claim 1, wherein the support body is made in one piece.

9. The support body according to claim 1, wherein said holes in profiles are in the form of elongated openings .

10. The support body according to claim 1, wherein said reinforcing profiles are continuous.

11. The support body according to claim 1, wherein said plurality of reinforcing profiles are rigidly joined together.

12. The support body according to claim 1, wherein said reinforcing profiles are in the form of tubes.

13. A support body assembly for an apparatus having an extended nip, comprising:

a support body having a working surface, and being elastically deformable, and comprising a plurality of pressure chambers said nip being formed between the support body and a counter-pressure member, said chambers being arranged to be pressurized in order to load the nip via said working surface; and a holding device for the support body, the holding device providing an outer support to all sides of the support body having said pressure chambers except the side of the working surface so that a pressurization of the pressure chambers cause the pressure chambers to expand in a controlled manner in the direction of said working surface, wherein the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

14. The support body assembly according to claim 13, wherein the working surface of the support body is covered by an exchangeable, thin wear protection layer having one side edge portion rigidly affixed to an upstream side of the holding device and an opposite side edge portion that is free to follow movement and deformation of the support body.

15. An apparatus for the treatment of a fibre web being manufactured in a paper or board machine, comprising:

a first structural element, and a second structural element movably arranged with respect to the first structural element and having a counter-pressure surface for interaction with the first structural element to form an extended nip, said first structural element including:

a movable belt;

a support body assembly, including a support body having a working surface that together with the counter-pressure surface defines said nip, said support body being elastically deformable and comprising a plurality of pressure chambers arranged to be pressurized in order to load the nip via said working surface; and a holding device for the support body, the holding device providing an outer support to sides of the pressure chambers except at a side of the pressure chambers facing said working surface so that a pressurization of the pressure chambers cause the pressure chambers to expand in the direction of said working surface, wherein the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

16. A method of forming an extended nip in an apparatus for the treatment of a fibre web, said apparatus comprising a support body having a working surface, and being elastically deformable, and comprising a plurality of pressure chambers said nip being formed between the support body and a counter-pressure member, said chambers being arranged to be pressurized in order to load the nip via said working surface, wherein the method comprises the steps of:

mounting the support body in a holding device, the holding device providing an outer support to all sides of the support body having said pressure chambers except the side of the working surface, and pressurizing the pressure chambers to cause the pressure chambers to expand in a controlled manner in the direction of said working surface, wherein the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

17. A method of controlling the load in an extended nip in an apparatus for the treatment of a fibre web, said apparatus comprising a support body having a working surface, and being elastically deformable, and comprising a plurality of pressure chambers said nip being formed between the support body and a counter-pressure member, said chambers being arranged to be pressurized in order to load the nip via said working surface, wherein the method comprises the steps of:

mounting the support body in a holding device, the holding device providing an outer support to all sides of the support body having said pressure chambers except the side of the working surface, pressurizing the pressure chambers to cause the pressure chambers to expand in a controlled manner in the direction of said working surface, and setting the pressures in the pressure chambers in accordance with a predetermined pattern to obtain a desired press curve, wherein the support body further comprises a plurality of reinforcing profiles disposed in at least one chamber of said plurality of pressure chambers, the interiors of the profiles being in fluid communication with one another via holes provided between said profiles, a wall of the profile facing said working surface including holes for communicating fluid between the interior of the profile and the chamber in which said profile is located, said plurality of profiles providing an inner support to walls defining said at least one chamber.

18. The method according to claim 17, wherein the load in the press nip is controlled independently in the machine direction and/or crosswise to the machine direction.

19. The support body according to claim 1 wherein the support body is used as a press body in a press apparatus in a paper or board machine.

20. The support body according to claim 1 wherein the support body is used as a supporting foil for a carrying apparatus in a paper or board machine.

21. The support body according to claim 1 wherein the support body is used as a reeling support in a reel-up of a paper or board machine.

* * * * *